United States Patent [19]

Honma et al.

[11] 4,451,167

[45] May 29, 1984

[54] PRINTING DEVICE WITH SWING-AWAY CUTTER ARRANGEMENT

[75] Inventors: Takao Honma; Nobuaki Matsukura; Keisuke Murakami; Susumu Matsuda, all of Shizuoka, Japan

[73] Assignee: Tokyo Electric Co., Ltd., Tokyo, Japan

[21] Appl. No.: 391,156

[22] Filed: Jun. 23, 1982

[30] Foreign Application Priority Data

Jun. 30, 1981 [JP] Japan ..... 56-100468

[51] Int. Cl.[3] ..... B41J 11/70

[52] U.S. Cl. ..... 400/621; 101/93.07; 346/24

[58] Field of Search ..... 400/621, 248; 101/93.07; 346/24

[56] References Cited

U.S. PATENT DOCUMENTS 3,951,252 4/1976 Selke et al. ..... 400/621

4,110,050 8/1978 Wood et al. ..... 400/248

4,391,541 7/1983 Einem ..... 400/248

*Primary Examiner*—Paul T. Sewell

*Attorney, Agent, or Firm*—Frishauf, Holtz, Goodman & Woodward

[57] ABSTRACT

The invention provides a printing device in which a cutter unit for printing medium is rotatably supported by a pivot on the printing device body and located in such a position as to permit the printing head to be covered or exposed. The cutter unit, in its closed inoperable state, is interlockingly operated through an engaging lever by a separate drive system housed in the device body, but may be brought into or out of an interlocking engagement with the drive system, whereby a series of maintenance and checking operations such as the mounting and replacement of the ink ribbon, the cleaning of the interior of the printing device body and the removal of a jammed paper are carried out.

8 Claims, 13 Drawing Figures

FIG. 1
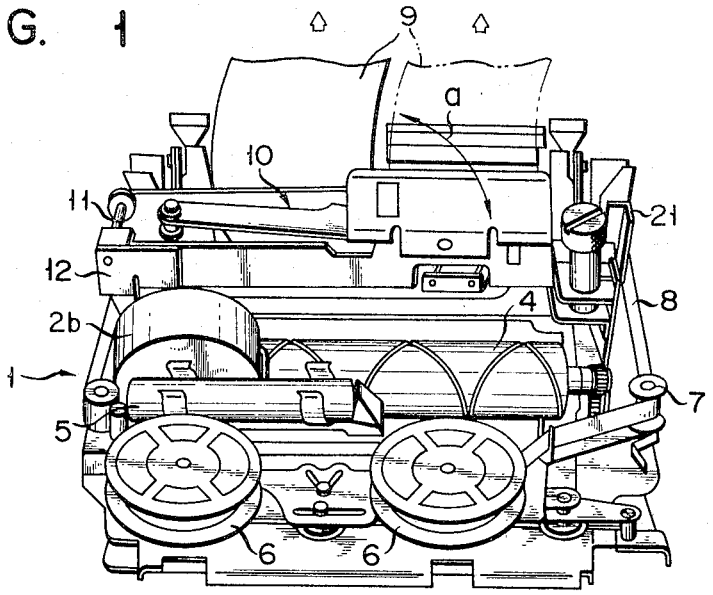
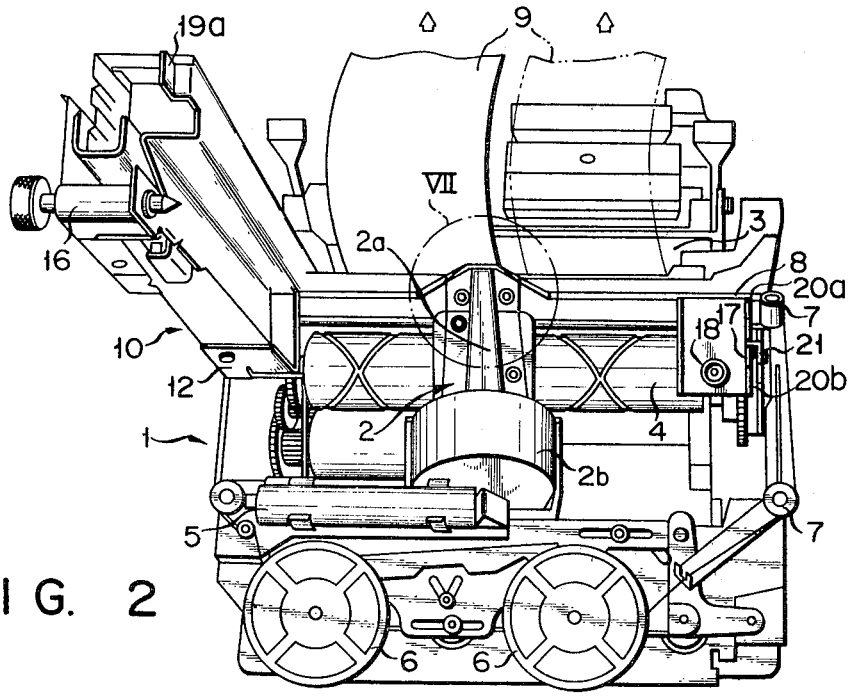
FIG. 2

FIG. 3
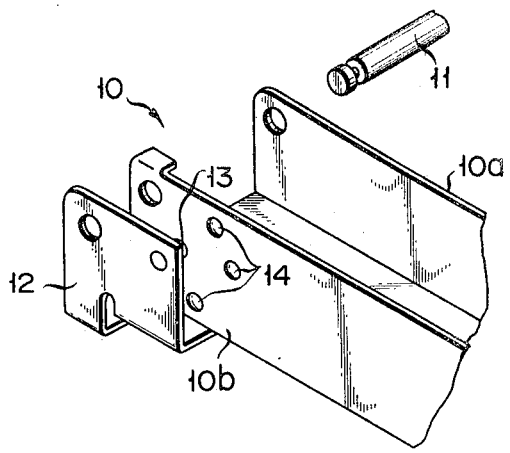
FIG. 4
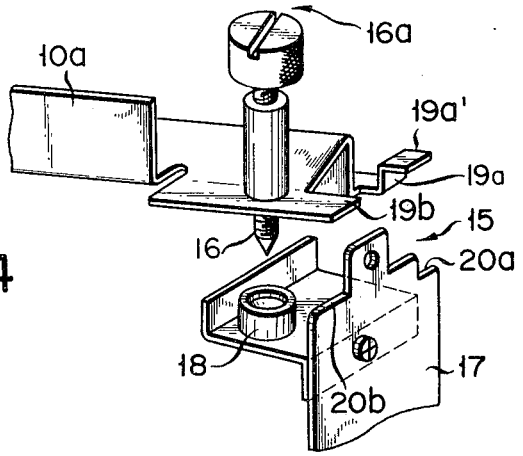
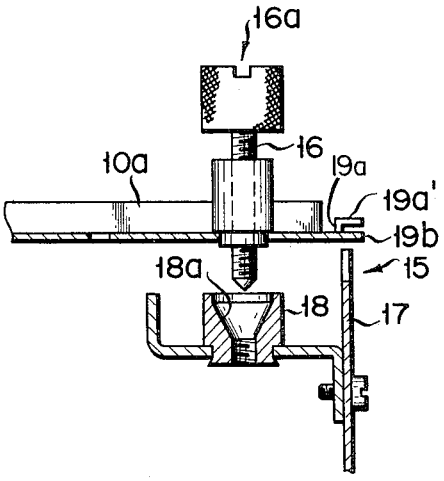
FIG. 5

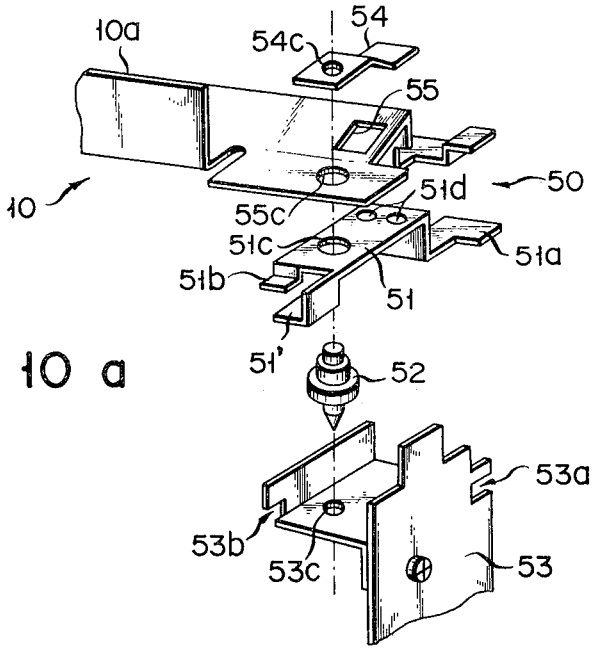
FIG. 10 a
FIG. 10 b
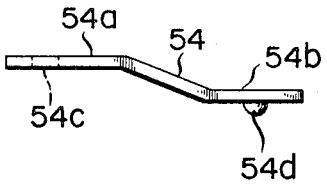
FIG. 11
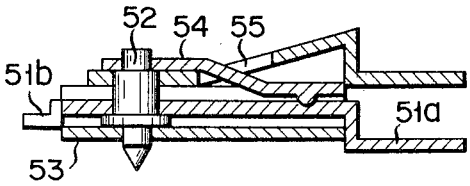

PRINTING DEVICE WITH SWING-AWAY CUTTER ARRANGEMENT

BACKGROUND OF THE INVENTION

This invention relates to a printing device for use in an electronic cash machine, such as a cash register.

Generally, a printing device of this type is equipped with a cutter mechanism and stamp mechanism in a printing device body. A printing sheet, such as a receipt sheet, is printed by a printing head on the device body with an ink ribbon therebetween and, after a mark is stamped by the stamp mechanism on the receipt sheet, the sheet is cut by the cutter mechanism. In the conventional printing device, however, a printing head portion is disposed below the cutter mechanism and stamp mechanism, i.e., near a position where these mechanisms can cover the printing head and are fixed relative to the device body, making it difficult to effect the mounting and replacement of the ink ribbon disposed to face the forward end of the printing head, as well as the cleaning, etc., of the interior of the device body. Moreover, where the printing paper is caught or jammed on the laterally moving printing head, the paper removing operation is difficult and in addition the maintenance and checking are also cumbersome.

SUMMARY OF THE INVENTION

One object of this invention is to provide a printing device having a swing-away cutter unit which comprises a built in cutter mechanism, stamp mechanism, etc., and which is pivotally supported on a printing device body such that it can cover or expose a printing head portion, whereby a series of maintenance and checking operations such as the mounting and replacement of the ink ribbon, the cleaning of the interior of the printing device body and the removing of jammed paper are more easily carried out.

Another object of this invention is to provide a printing device capable of making a cutter unit per se and thus the device compact as a whole and permitting ready assembly, by providing a cutter mechanism, stamp mechanism, etc., of a cutter unit as a driven system for a drive system of a printing device body and causing the driven system to be brought into or out of an interlocking engagement with the drive system on the printing device body side through an engaging member.

Another object of this invention is to provide a printing device capable of preventing dropping of an ink ribbon, as well as paper jamming, by providing a guide portion on an ink ribbon guide moved together with a printing head to permit the lower edge of the ribbon to be guided and providing inclined guide portions on both the end slides of the ribbon guide such that they are inclined in a direction of movement of a printing head.

BRIEF DESCRIPTION OF THE DRAWINGS

FIGS. 1 and 2, each, show a perspective view schematically showing a printing device according to one embodiment of this invention;

FIG. 3 is an exploded, perspective view showing a pivotal portion at which one end of a cutter unit is pivotally mounted on a printing device body;

FIG. 4 is a perspective view showing a fixing mechanism portion at the other end of the cutter unit which is disposed relative to the printing device body;

FIG. 5 is a partial, cross-sectional view showing the fixing mechanism portion;

FIGS. 10 and 11, each show a printing device according to another embodiment of this invention, and FIG. 10*a* shows an exploded, perspective view showing another fixing mechanism portion of a cutter unit and FIG. 10*b* is a side view showing a fixing plate of the fixing mechanism portion; and FIG. 11 is a cross-sectional view showing the assembled state of the fixing mechanism portion in FIG. 10.

DETAILED DESCRIPTION OF THE PREFERRED EMBODIMENTS

Figure 6A:
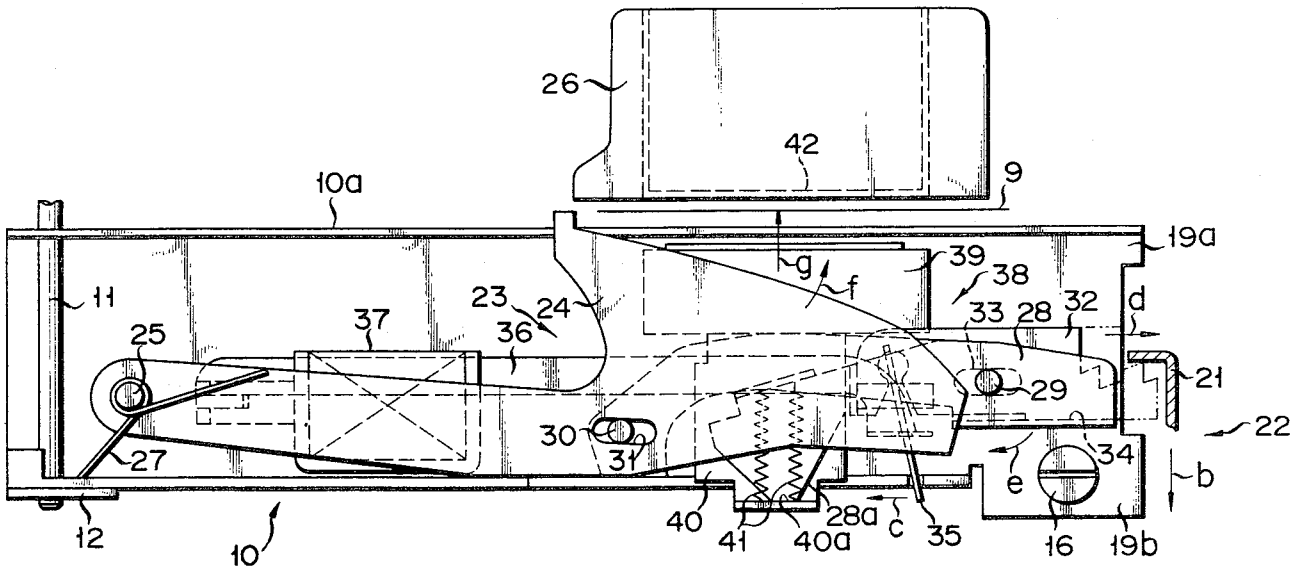
FIG. 6*a* is a plan view showing an arrangement of a driven system, such as a cutter mechanism, stamping mechanism, etc., in the cutter unit.

In FIGS. 1 and 2, reference numeral 1 shows a body of a printing device of which the printing mechanism comprises a printing head 2 which comprises a wire guide section 2*a* and a magnet block section 2*b*. The printing mechanism further includes platen 3, printing head feeding cam 4, cartridge 5, ribbon spools 6, ribbon guide pins 7, and ink ribbon 8. The ink ribbon 8 is arranged along the platen 3 such that it confronts the printing head 2. Reference numeral 9 shows a printing paper. A pair of printing papers 9, are fed in two rows in a direction of arrows in FIG. 1 from a roll (not shown) in the device body 1. After printing has been performed, one of the printing papers is wound on a take-up drum (not shown) which is arranged in the device body, while the other is stamped and cut by a stamp mechanism and a cutter mechanism, respectively, of a later-described cutter unit so that it may be used as a receipt sheet, etc. One end of the cutter unit 10 is supported by a pivot 11 on the device body 1 such that it is rotated in a direction of an arrow a (FIG. 1) with the pivot 11 as a fulcrum to permit a portion of the printing head 2 to be covered or exposed.

As shown in FIG. 3 the end portion of a unit case 10*a* which constitutes a body of the cutter unit 10 is spring urged against and supported by a retaining member 12 comprised of a leaf spring disposed on the side of the device body 1 and these members are attached by the pivot 11 as mentioned above. An engaging projection 13 is formed on the inner wall surface of the retaining member 12, i.e., on that wall surface of the member 12 which is spring-urged against the unit case 10*a*. A plurality of engaging holes 14 are arcuately formed in a spaced-apart relation on that side wall 10*b* of the unit case 10*a* confronting the engaging projection 13, with the pivot 11 as the center of the arc. The cutter unit 10 is arranged such that it can be held at a predetermined rotation angle by causing the projection 13 to be properly engaged with one of the engaging holes 14. A fixing mechanism 15 is provided at the other end of the cutter unit 10 as shown in FIGS. 4 and 5 to fix the unit 10 to the printing device body 1. The fixing mechanism 15 is so arranged that it positions the cutter unit 10 relative to the device body 1 in its up and down directions by causing a fixing screw 16 on the side of the unit case 10*a* to be threadably secured to a hub 18 provided on a fixing member 17 at the printing device body side. An inclined guide surface 18*a* (FIG. 5) is formed on the inner surface of the hub 18 to facilitate the threadable insertion of the fixing screw 16 therein. The cutter unit 10 is located with respect to its forward and backward directions by causing projections 19*a*, 19*b* formed at the forward end of the case 10*a* to be engaged with, or abutted against, stepped portions 20*a*, 20*b* formed on the forward end portion of the fixing member 17. A forward, outturned portion 19*a*' of the projection 19*a* provides a grip section when the unit is opened. A groove 16*a* is provided in the top of the head of the fixing screw 16 to permit, for example, a coin to be fitted therein. The outer periphery of the head of the fixing screw 16 is knurled to provide an antiskid section. These features permit the fixing screw 16 to be readily tightened and loosened.

A cutter mechanism 22 and stamp mechanism 38 are received within the cutter unit 10. These mechanisms are operated in interlock with a drive system on the side of the device body to provide what we called a driven system. The operation of these mechanisms will be explained below by referring to FIG. 6*a*.

A cutter 24 is rotatably supported on a cutter shaft 25 attached to the unit case with a return spring 27 anchored to the cutter shaft 25. A fixed cutting edge 26 is disposed on the side of the device body 1 to face the cutter 24. During the operation the cutter 24 is brought into abutting engagement with the fixed cutting edge 26 to cut the printing paper as will be explained later. An operation lever 28 is disposed below the cutter 24 and one end portion of the operation lever 28 is rotatably supported on a lever shaft 29 attached to the unit case. An engaging pin 30 is attached to the other end portion of the operation lever 28 and inserted into an elongated engaging hole 31 which is formed in the cutter 24. A switching lever 32 is disposed below the operation lever 28. The switching lever 32 has an elongated sliding hole 33 through which a lever shaft 29 extends. The switching lever 32 is guided by the lever shaft 29 in the sliding hole 33 and slidably moved in a direction of an arrow d along an outturned portion 34 which is provided by bending the edge portion of the operation lever 28. When the switching lever 32 is slidably moved in the direction of the arrow d to a position as indicated by a phantom line, the forward end of the lever 32 is brought into interlocking engagement with a drive lever 21 of a drive system on the side of the device body 1. The engaging lever 21 is arranged such that, as shown in FIG. 6*b*, the intermediate portion of the engaging lever 21 is pivotally mounted on a projecting shaft 1*a* attached to the device body 1, the upper end portion of the engaging lever 21 has an engaging portion 48 adapted to be brought into or out of engagement with the forward stepped portion of the switching lever 32 and the lower end of the engaging lever 21 is abutted against a cam 50 which is mounted on a rotation shaft 49 adapted to be driven in interlock with the drive system on the side of the device body 1. The engaging lever 21 is rotated according to the motion of the cam 50 which is rotated in a direction of an arrow in FIG. 6*b* and the engaging portion 48 of the engaging lever 21 is moved in the direction of an arrow b in FIG. 6*b* into engagement with the switching lever 32 on the cutter unit side to cause the associated driven system to be driven in interlocking relation.

Figure 6B:
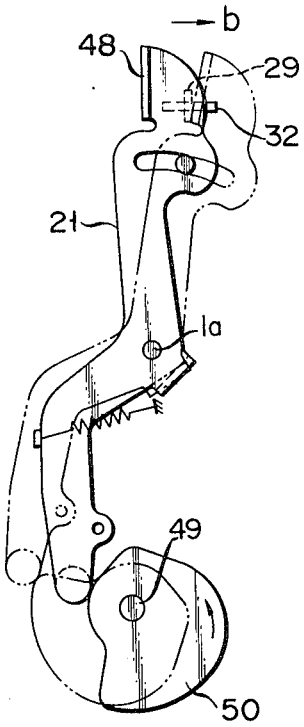
FIG. 6*b* is a side view showing an arrangement of a drive lever on the drive system of the printing device body which is operated in interlock with a driven system.

In FIG. 6*a*, reference numeral 35 is an operation lever adapted to cause the switching lever 32 to be slidably moved. The operation lever 35 is connected to a connecting rod 36 attached to the solenoid 37 and rotated in a direction of an arrow c in FIG. 6*a* by the operation of the solenoid. A stamp 39 of a stamp mechanism 38 is arranged below the cutter 24 and a stamp rest 42 is disposed below the fixed cutting edge 26. A stamp base 40 is integrally mounted on the stamp 39 and the stamp base 40 is connected to the operation lever 28 through springs 41. That is, the springs 41 are anchored at one end to an end 40*a* of the stamp base 40 and at the other end to the side edge of the operation lever 28. An abutting section 28*a* extends from the side edge of the operation lever 28. By causing the forward end of the abutting section 28*a* to abut against the end 40*a* of the stamp base 40 the springs 41 are held such that they are normally urged in a tension direction.

Figure 7:
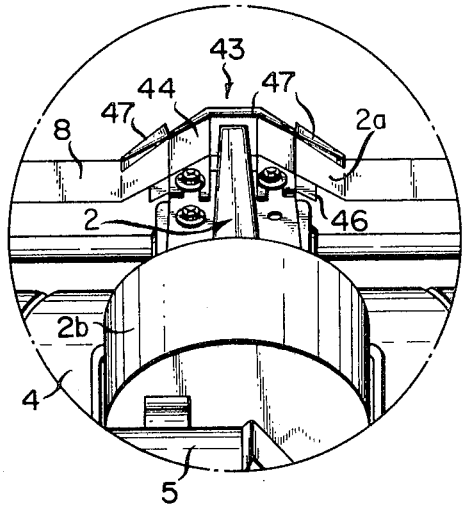
FIG. 7 is an enlarged, perspective view showing a printing head portion as indicated by VII in FIG. 2.
Figure 8:
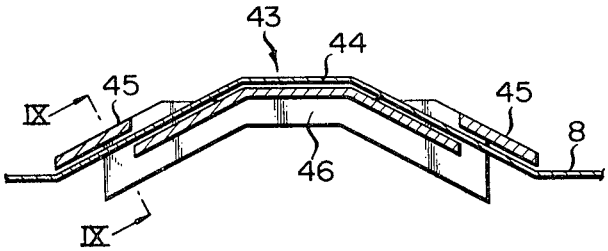
FIG. 8 is a cross-sectional view showing a ribbon guide.
Figure 9:
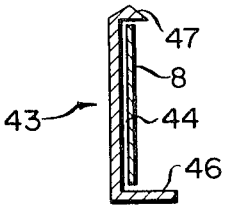
FIG. 9 is a cross-sectional view of the ribbon guide as taken along line IX—IX in FIG. 8.

The forward end portion of the printing head 2 is so configured as shown in FIGS. 7 to 9. A ribbon guide 43 has guide surface portions 44 and 45, 45 for guiding the ink ribbon 8 and the lower ends of the respective guide surface portions have a range of guide surface 46 along the lower edge of the ink ribbon 8. The upper ends of the respective guide surface portions have guide portions 47, . . . which are outturned on the side of the ink ribbon 8. The guide surface portions 45 are located on both the end sides of the ribbon guide 43, i.e. on the entry and exit end sides of the ink ribbon 8, such that they are inclined in a direction of movement of the printing head 2 as shown in FIG. 8.

The printing device so arranged will be explained below.

When the solenoid 37 in the cutter unit 10 as shown in FIG. 6 is energized to cause the operation lever 35 to be rotated through the connecting rod 36 in the direction of the arrow c, the switching lever 32 is slidably moved in the direction of d as indicated by the phantom line in FIG. 6, causing the forward stepped portion of the switching lever 32 to be brought into engagement with the engaging lever 21 to permit the driven system, such as the cutter and stamp mechanism, to be held ready to be operated. After a predetermined printing has been effected by the printing head 2 on the printing papers 9, one of the printing papers is stamped and cut as a receipt sheet. Such stamping and cutting operations are performed as follows:

By moving the engaging lever 21 in the direction of the arrow b in FIG. 6*a* the switching lever 32 which is engaged with the engaging portion 48 of the engaging lever 21 is rotated in the direction of the arrow b in FIG. 6*a*, causing the outturned section 34 of the operation lever 28 to be urged to rotate the lever shaft 29 in the direction of the arrow e with the lever shaft 29 has a center. At the same time, the cutter 24 engaged with the engaging pin 30 of the operation lever 28 is rotated in the direction of the arrow f with the cutter shaft 25 as a center, causing the printing paper to be cut by the cutter 24 and fixed cutting edge 26 as a receipt sheet 9. On the other hand, the abutting section 28*a* is moved away from the end 40*a* of the stamp base 40 by the rotation of the operation lever 28 in the direction of the arrow e in FIG. 6*a*, causing a returning force to be induced in the springs 41 which are stretched in the "pulled" state between the operation lever 28 and the end 40*a* of the stamp base. This causes the stamp base 40 and the stamp 39 integral therewith to be pushed ahead in the direction of g in FIG. 6*a*, pressing the receipt sheet 9 against the stamp rest 42 to permit a mark to be stamped by the stamp 39 on the receipt sheet. In this way the stamping and cutting of the printing paper are carried out. At the completion of these operations the engaging lever 21 is returned to the original position, causing the switching lever 32 and operation lever 28 as well as the driven system, such as the stamp 39 and cutter 24, operated in interlock with these levers to be returned by the returning spring 27 to the original position, that is, causing the switching lever 32 to be moved back to the above-mentioned ready state, while causing the stamp 39 and cutter 24 to be returned to the original position.

In this printing device, the replacement, maintenance, checking, etc. of the ink ribbon 8 are carried out as follows:

After the deenergization of the solenoid, the operation lever 35 is rotated in a direction opposite to the direction of the arrow c in FIG. 6*a*, causing the switching lever 32 to be slidably moved in a direction opposite to the direction of d in FIG. 6*a* and causing the lever 32 to be disengaged from the engaging lever 21 to permit the above-mentioned ready state of these members to be released. Then, the fixing screw 16 is loosened away from the fixing member 17. Then, the cutter unit 10 is rotated in the direction of the arrow a, i.e. toward the open side, with the pivot 11 as a center and held there. With the forward end portion of the printing head 2 so exposed, the mounting and replacement of the ink ribbon as well as the cleaning, etc. of the interior of the device body can be readily carried out. The ready replacement of the printing head 2 per se can also be carried out. Even if the receipt sheet 9 is caught on printing head 2 to cause jamming to occur between the printing head 2 and the cutter unit 10, the interior of the device 1 can be exposed by the rotation of the unit 10, offering the advantages of readily removing a jammed paper as well as readily effecting the maintenance and checking. Since the ink ribbon 8 is guided while substantially vertically restricted by the range of the guide surface 46 on the lower side of the ribbon guide 43 at the forward end side of the printing head 2 as well as by the outturned guide portions 44, 45, 45 of the upper end of the respective guide surface portions, it is possible to positively prevent a drop of the ribbon during the operation of the device. As the guide surface portions 45 at both the end portions of the ribbon guide 43 are inclined in the direction of movement of the printing head, it is possible to prevent, for example, a possible wrinkling of the printing paper slidably moved along the guide surface portions during the operation of the device and thus a possible jamming. The engaging system, that is, the drive lever 21 permitting the driven system 23, such as the cutter mechanism 22 and stamp mechanism 38 in the cutter unit 10, to be operated in interlock therewith is provided on the printing device body side, permitting the obtainment of a small-sized cutter unit 10. As it is only necessary to rotatably support the unit 10 on one side of the device body, the printing device as a whole can be readily assembled.

While the fixing mechanism of the cutter unit of this application has been explained in connection with one embodiment as shown in FIGS. 4 and 5, this invention is not restricted thereto. The fixing mechanism may be of such a type as shown, for example, in FIGS. 10 and 11. In the fixing mechanism 50, use is made of a fixed lever 51 in place of the fixing screw 16. The fixing lever 51 is such that, as shown in FIG. 10*a*, engaging projections 51*a* and 51*b* are provided at both ends thereof with an insertion hole 51*c* and engaging holes 51*d*, 51*d* formed in the upper surface of a plate-like body thereof. In a fixing member 53 for fixing the fixing lever 51 in place, an engaging cutout 53*a* corresponding to the engaging projection 51*a* is provided in the forward end wall of the member 53 and an engaging cutout 53*b* corresponding to the engaging projection 51*b* is formed in the side wall portion of a supporting plate which has an insertion hole 53*c*. 54 shows a leaf plate like fixing plate having a stepped portion. As shown in FIG. 11, a fixing plate 54 has an insertion hole 54*c* in one side section 54*a* and an engaging projection 54*d* on the lower surface of the other side section 54*b*. As shown in FIG. 11, the upper end of a fixing shaft 52 is inserted into the insertion hole 51*c* of the lever 51 and insertion hole 55*c* in a unit case 10*a* and the fixing plate 54 is inserted into an opening 55 of the unit case 10*a* with the side section 54*b* thereof located at the lower side to spring-urge the upper surface of the fixing lever 51. The side section 54*a* of the fixing plate is left at the upper side, and the upper end of the fixed shaft 52 which extends through the insertion hole 55*c* of the unit case 10*a* is inserted through the insertion hole 54*c* in the side portion 54*a* and riveted.

By so doing, the fixing lever 51 is rotatably supported on the lower surface of the unit case 10*a* and, when the lever 51 is rotated, the engaging projection 54*d* of the fixing plate 54 can be snap-fitted into either one of the engaging holes 51*d*, thus restricting the rotation position.

When the lever 51 is rotated by gripping the knob section 51' to cause the engaging projections 51*a* and 51*b* of the lever 51 to be engaged with the engaging cutouts 53*a* and 53*b*, respectively, it is possible to position the cutter unit 10 relative to the device body in the up and down directions as well as in the forward and backward directions.

According to the fixing mechanism 50, the cutter unit 10 can be readily opened and closed, as well as readily fixed in place as in the preceding embodiment without using any fixing screw.

What we claim is:

1. A printing device with a cutter arrangement comprising:

a printing body including a platen over which a printing medium is movable during a printing operation;

an ink ribbon located along said platen;

a printing head facing said ink ribbon and said platen;

means for moving the printing head along said platen during a printing operation;

a cutter unit having one end rotatably mounted on said printing body and which is rotatable between an open position whereat said printing head is exposed and a closed position whereat said cutter unit covers at least a part of said printing head;

said cutter unit including a driven system located within said cutter unit, said driven system including a cutter means and an actuation transmitting means, both mounted within said cutter unit;

a drive system mounted within said printing body; and an engaging lever mounted on said drive system and which is engageable with said actuation transmitting means, when said cutter unit is in its said closed position, to couple said drive system to said driven system to thereby operate said cutter means of said driven system via said drive system, said driven system being disengaged from said drive system when said cutter unit is in its open position.

2. The printing device of claim 1, wherein latching means is provided to hole said cutter unit and driven system in a selected rotated open position in which said printing head is exposed during a non-printing operation.

3. The printing device of claim 1, further comprising means for holding said cutter unit it its said closed position.

4. The printing device of claim 1, wherein said cutter unit further comprises a solenoid having an operation arm connected to said actuation transmitting means.

5. The printing device of claim 1, wherein said actuation transmitting means includes a switching lever engageable with said engaging lever; and an operation lever coupled to said switching lever.

6. The printing device of claim 5, wherein said cutter means includes a cutting edge rotatably mounted on said cutter unit at one end in engagement with said operation lever and rotatable in a direction perpendicular to said printing medium; and a spring means coupled to said cutting edge at said one end thereof.

7. The printing device of claim 5, wherein said operation lever includes a stamp means having a stamp connected thereto via a spring and movable in a direction perpendicular to said printing medium.

8. The printing device of claim 1, further comprising:

a ribbon guide for guiding said ink ribbon, said ribbon guide including a guide portion at the lower end thereof for guiding said ink ribbon; and a guide for guiding said printing medium, said printing medium guide including inclined guide portions provided on both end portions of said ribbon guide, said inclined guide portions being inclined in the direction of movement of said printing head.

* * * * *